US011754065B2

(12) United States Patent
Nguyen et al.

(10) Patent No.: US 11,754,065 B2
(45) Date of Patent: Sep. 12, 2023

(54) PERISTALTIC PUMP WITH SLIDING CHASSIS CONNECTED TO COVER

(71) Applicant: BLUE-WHITE INDUSTRIES, LTD., Huntington Beach, CA (US)

(72) Inventors: John T. Nguyen, Fountain Valley, CA (US); Robert E. Gledhill, III, Huntington Beach, CA (US)

(73) Assignee: Blue-White Industries, Ltd., Huntington Beach, CA (US)

( * ) Notice: Subject to any disclaimer, the term of this patent is extended or adjusted under 35 U.S.C. 154(b) by 0 days.

(21) Appl. No.: 17/233,163

(22) Filed: Apr. 16, 2021

(65) Prior Publication Data

US 2021/0324845 A1 Oct. 21, 2021

Related U.S. Application Data

(60) Provisional application No. 63/012,719, filed on Apr. 20, 2020.

(51) Int. Cl.
*F04B 43/12* (2006.01)
*F04B 43/08* (2006.01)

(52) U.S. Cl.
CPC ..... *F04B 43/1284* (2013.01); *F04B 43/08* (2013.01)

(58) Field of Classification Search
None
See application file for complete search history.

(56) References Cited

U.S. PATENT DOCUMENTS 4,256,442 A * 3/1981 Lamadrid ..... F04B 43/1284 417/475
4,362,118 A * 12/1982 Koch, Jr. ..... E05F 1/1276 114/178
4,518,327 A * 5/1985 Hackman ..... F04B 43/1253 417/477.3
5,082,429 A 1/1992 Soderquist et al.
5,928,177 A * 7/1999 Brugger ..... A61M 1/3639 604/6.11
6,203,296 B1 * 3/2001 Ray ..... A61M 5/142 417/477.2

(Continued)

FOREIGN PATENT DOCUMENTS

EP 1 518 572 A1 3/2005
EP 3 483 440 A1 5/2019

(Continued)

*Primary Examiner* — Essama Omgba
*Assistant Examiner* — Geoffrey S Lee
(74) *Attorney, Agent, or Firm* — Knobbe, Martens, Olson & Bear, LLP

(57) ABSTRACT

A peristaltic pump can include a chassis and a chassis retaining portion forming a cavity. The pump can also include a rotor, a cover, and a linkage. The rotor can be disposed within the cavity such that tubing can be held between the rotor and the chassis and/or the chassis retaining portion. The linkage can couple the cover to the chassis. The linkage can include an arm. When opening the cover, the arm can pivot such that the chassis moves away from the chassis retaining portion to widen the cavity. When closing the cover, the arm can pivot such that the chassis moves toward the chassis retaining portion. When closed, a stop can restrict further movement of a corresponding member toward the chassis retaining portion.

20 Claims, 11 Drawing Sheets

(56) References Cited

U.S. PATENT DOCUMENTS

| | | | | |
|---|---|---|---|---|
| 7,001,153 | B2 | 2/2006 | McDowell et al. | |
| 7,284,964 | B2 | 10/2007 | McDowell et al. | |
| 7,478,999 | B2 | 1/2009 | Limoges | |
| 7,980,835 | B2 | 7/2011 | LaBanco et al. | |
| 8,052,399 | B2 | 11/2011 | Stemple et al. | |
| 8,215,931 | B2 | 7/2012 | McDowell et al. | |
| 8,418,364 | B2 | 4/2013 | McDowell et al. | |
| 8,639,363 | B2 | 1/2014 | Gledhill, III et al. | |
| 9,374,024 | B2 | 6/2016 | Nguyen et al. | |
| 9,389,109 | B2 | 7/2016 | Gledhill, III et al. | |
| 9,777,720 | B2 | 10/2017 | Gledhill, III et al. | |
| 9,828,984 | B2 | 11/2017 | Gledhill, III et al. | |
| 9,909,579 | B2 | 3/2018 | Gledhill, III et al. | |
| 9,996,089 | B2 | 6/2018 | Gledhill, III et al. | |
| 10,330,094 | B2 | 6/2019 | Gledhill, III et al. | |
| 10,948,320 | B2 | 3/2021 | Gledhill, III et al. | |
| 11,131,300 | B2 | 9/2021 | Gledhill, III et al. | |
| 11,150,118 | B2 | 10/2021 | Gledhill, III et al. | |
| 11,221,004 | B2 | 1/2022 | Gledhill, III et al. | |
| 11,261,857 | B2 | 3/2022 | Gledhill, III et al. | |
| D959,238 | S | 8/2022 | Nguyen et al. | |
| 11,402,248 | B2 | 8/2022 | Gledhill, III et al. | |
| 11,485,653 | B2 | 11/2022 | Gledhill, III et al. | |
| 11,578,716 | B2 | 2/2023 | Gledhill, III et al. | |
| 2005/0069436 | A1* | 3/2005 | Shibasaki | A61M 60/37 417/474 |
| 2005/0254978 | A1* | 11/2005 | Huber | A47L 15/4418 417/474 |
| 2007/0140880 | A1* | 6/2007 | Fulmer | F04B 43/1253 417/477.1 |
| 2009/0129944 | A1* | 5/2009 | Stemple | F04B 43/1284 417/476 |
| 2010/0005655 | A1 | 1/2010 | Nguyen | |
| 2010/0224547 | A1* | 9/2010 | Fujii | A61M 5/14232 210/236 |
| 2011/0004161 | A1* | 1/2011 | Ito | A61M 5/14232 604/154 |
| 2011/0180172 | A1 | 7/2011 | Gledhill, III et al. | |
| 2011/0300010 | A1* | 12/2011 | Jarnagin | A61M 1/82 417/477.2 |
| 2013/0115120 | A1* | 5/2013 | Jarnagin | F04B 43/12 417/477.2 |
| 2015/0211509 | A1 | 7/2015 | Gledhill, III et al. | |
| 2018/0003169 | A1* | 1/2018 | Van Stell | F04B 49/06 |
| 2018/0087942 | A1 | 5/2018 | Gledhill, III et al. | |
| 2018/0291886 | A1 | 10/2018 | Gledhill, III et al. | |
| 2018/0298891 | A1 | 10/2018 | Gledhill, III et al. | |
| 2019/0017499 | A1 | 1/2019 | Gledhill, III et al. | |
| 2019/0234394 | A1 | 8/2019 | Gledhill, III et al. | |
| 2020/0025190 | A1 | 1/2020 | Van Stell | |
| 2020/0149522 | A1 | 5/2020 | Gledhill, III et al. | |
| 2020/0386593 | A1 | 12/2020 | Nguyen et al. | |
| 2021/0047209 | A1 | 2/2021 | Gledhill, III et al. | |
| 2021/0054963 | A1 | 2/2021 | Nguyen et al. | |
| 2021/0064735 | A1 | 3/2021 | Gledhill, III et al. | |
| 2021/0348602 | A1 | 11/2021 | Nguyen et al. | |
| 2022/0099083 | A1 | 3/2022 | Gledhill, III et al. | |
| 2022/0276082 | A1 | 9/2022 | Gledhill, III et al. | |
| 2022/0316463 | A1 | 10/2022 | Gledhill, III et al. | |
| 2023/0015391 | A1 | 1/2023 | Nguyen et al. | |

FOREIGN PATENT DOCUMENTS

| | | | | |
|---|---|---|---|---|
| GB | 2538556 | A * | 11/2016 | F04B 43/1253 |
| JP | 2019-210926 | A | 12/2019 | |
| WO | WO 2019/012106 | A1 | 1/2019 | |

* cited by examiner

PERISTALTIC PUMP WITH SLIDING CHASSIS CONNECTED TO COVER

INCORPORATION BY REFERENCE TO ANY PRIORITY APPLICATIONS

This application claims priority to U.S. Provisional Application No. 63/012,719, filed Apr. 20, 2020, and entitled "PERISTALTIC PUMP," the disclosure of which is hereby incorporated by reference in its entirety.

BACKGROUND

Field

The present disclosure relates generally to peristaltic pumps. More particularly, the present disclosure relates to peristaltic pumps with improved tubing installation and methods of installing tubing into peristaltic pumps.

Description of the Related Art

A peristaltic roller pump typically has rollers. The rollers can be spaced apart and mounted on a rotating carrier that moves the rollers in a circle. A length of flexible tubing can be placed between the rollers and a semi-circular wall. In medical applications, the tubing can be a relatively soft and pliable rubber tubing. For relatively high pressure industrial applications, however, the tubing can be exceedingly durable and rigid, albeit flexible under the high pressure of the rollers.

In use, the rollers can rotate in a circular movement and compress the tubing against the wall, squeezing the fluid through the tubing ahead of the rollers. The rollers can be configured to almost completely occlude the tubing, and operate essentially as a positive displacement pump, each passage of a roller through the semicircle pumps volume of the fluid contained in the tubing segment between the rollers.

As a positive displacement pump, relatively high positive pressures (e.g., 125 psi) or low positive pressures (e.g., 10 psi or less) can be generated at the pump outlet. Peristaltic roller pumps are typically driven by a constant speed motor that draws fluid at a substantially constant rate. Over time, the pressures at the pump outlet can wear on the tubing.

When tubing is replaced, the placement of the tubing underneath the rollers of the pump can be a very difficult task, especially in industrial applications. Typically, a user may attempt to replace the tubing by connecting one end of the tubing to one of the inlet or outlet ends of the pump and then forcibly bending the tubing around the rollers of the pump. This task is extremely difficult considering the narrow spacing between the rollers and the pump wall.

There have been attempts to adjust the spacing between the rollers and the pump wall. However, such attempts include parts that move and rattle in operation, making them usable only for relatively low pressure applications.

SUMMARY

In various implementations, a peristaltic pump is provided. The peristaltic pump can include a chassis and a chassis retaining portion forming a cavity. The peristaltic pump can also include a rotor, a cover, and a linkage. The rotor can be disposed within the cavity such that tubing can be held between the rotor and the chassis and/or the chassis retaining portion. The linkage can couple the cover to the chassis and can comprise an arm. When opening the cover, the arm can pivot such that the chassis moves away from the chassis retaining portion to widen the cavity. When closing the cover, the arm can pivot such that the chassis moves toward the chassis retaining portion. When closed, a stop can restrict further movement of a corresponding member toward the chassis retaining portion.

In some pumps, when closed, the corresponding member can be an end of the arm, and the end of the arm can be within 2 mm of the stop. In some pumps, when closed, each end of the arm can be within 1 mm of a first and second stop respectively. In some pumps, when closed, each end of the arm can contact the first and second stop respectively. In some pumps, when closed, the stop can restrict further movement of the corresponding member away from the chassis retaining portion.

In some implementations, the linkage can comprise a first pivot secured relative to the chassis and a second pivot secured relative to the cover. When opening and closing the cover, the cover can pivot about the second pivot, causing the arm to pivot about the first pivot. In some instances, the arm can comprise a first end and a second end, and the first end of the arm can be positioned at the first pivot. In some instances, when opening the cover, the cover can be configured to contact the second end of the arm to cause the arm to pivot about the first pivot.

In some pumps, the stop can be formed by an end of a groove, and the arm can be disposed within the groove. In some instances, the groove can be disposed in the chassis. In some instances, the arm can comprise a first end and a second end, and the first end of the arm can be disposed in a first groove and the second end of the arm can be disposed in a second groove. In some instances, the arm can comprise a first arm on a first side of the chassis and a second arm on a second side opposite the first side of the chassis.

In some implementations, the stop and corresponding member can comprise male or female connectors between the chassis and the chassis retaining portion. In some implementations, the stop and corresponding member can comprise male and female connectors between the cover and the chassis and/or chassis retaining portion.

In some implementations, the pump can comprise a lock configured to couple the cover and the chassis retaining portion. In some pumps, the rotor can be removable. In some instances, the pump can include a clip configured to couple the rotor and the chassis retaining portion to hold the rotor in place.

In various implementations, a method of installing tubing into a peristaltic pump is provided. The method can include providing the peristaltic pump. The peristaltic pump can comprise a chassis and a chassis retaining portion forming a cavity. The pump can also include a rotor, a cover, and a linkage. The rotor can be disposed within the cavity. The linkage can couple the cover to the chassis and can comprise an arm. The method can further comprise opening the cover, placing the tubing within the cavity, and closing the cover. Opening the cover can cause the arm to pivot such that the chassis can move away from the chassis retaining portion to widen the cavity. Closing the cover can cause the arm to pivot such that the chassis can move toward the chassis retaining portion. Closing the cover can also restrict further movement toward the chassis retaining portion.

In some methods, the closing step can comprise closing the cover so that when closed, an end of the arm can be within 2 mm of a stop. In some methods, the closing step can comprise closing the cover so that when closed, each end of the arm can be within 1 mm of a first and second stop respectively. In some methods, the closing step can comprise closing the cover so that when closed, each end of the arm can contact the first and second stop respectively.

In some instances, the method can comprise connecting male and female connectors between the chassis and the chassis retaining portion. In some instances, the method can comprise connecting male and female connectors between the cover and the chassis and/or chassis retaining portion.

In some implementations, the method can comprise locking the cover to the chassis retaining portion. In some implementations, the method can comprise placing a rotor within the cavity prior to closing the cover. In some implementations, the method can comprise placing a clip to hold the rotor in place.

BRIEF DESCRIPTION OF THE DRAWINGS

The features disclosed herein are described below with reference to the drawings of some implementations. The illustrated implementations are intended to illustrate, but not to limit the inventions. The drawings contain the following figures:

In FIG. 3A, the pump head is in a closed position. In FIG. 3B, the pump head is in an open position. In FIG. 3C, the pump head is in another open position.

FIG. 8A shows the pump head with a lock in a locked position. FIG. 8B shows the pump head with the lock in an unlocked position.

DETAILED DESCRIPTION

While the present description sets forth specific details of various implementations, it will be appreciated that the description is illustrative only and should not be construed in any way as limiting. Furthermore, various applications of such implementations and modifications thereto, which may occur to those who are skilled in the art, are also encompassed by the general concepts described herein.

Figure 1:
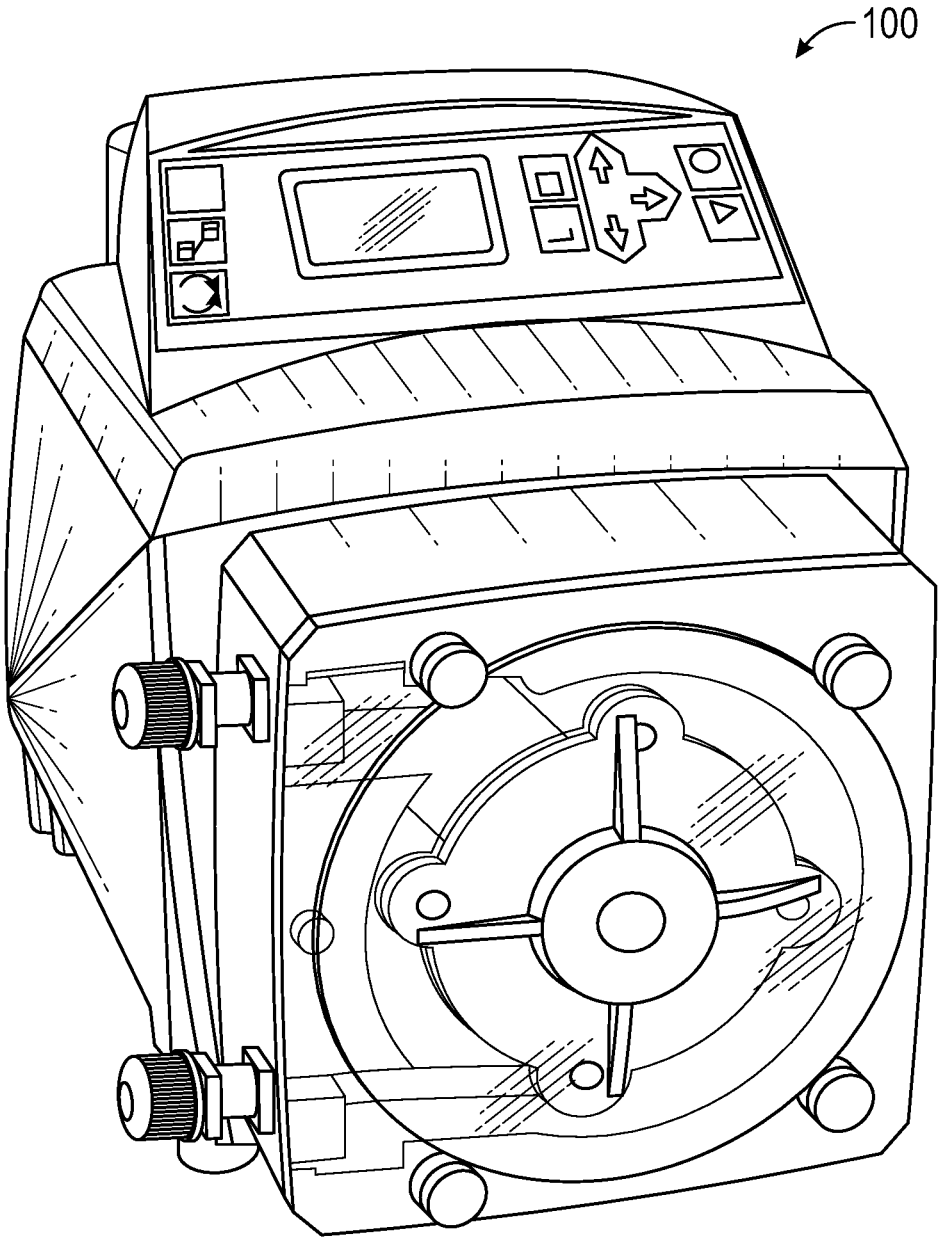
FIG. 1 is a perspective view of a peristaltic pump.
Figure 2:
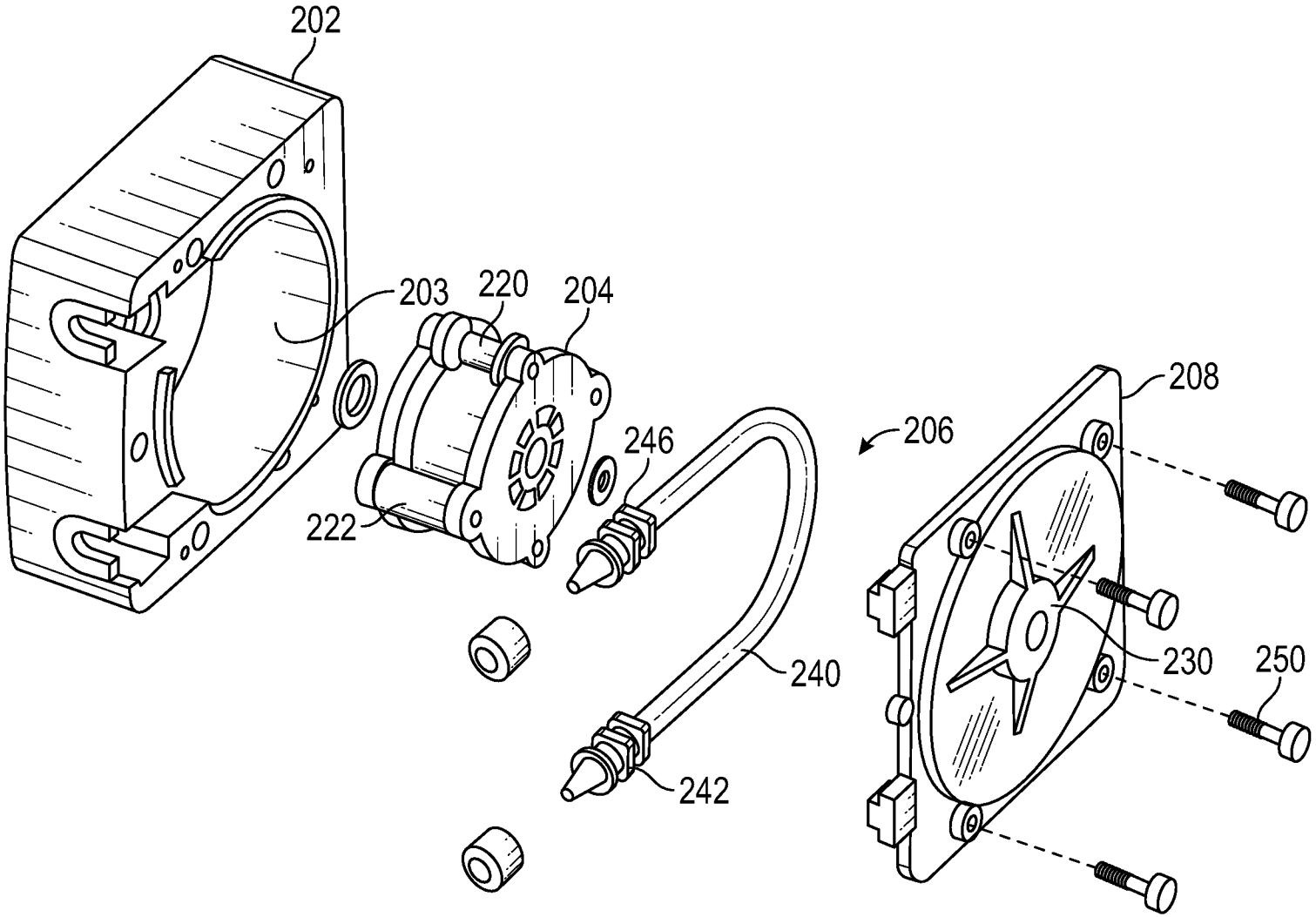
FIG. 2 is an exploded perspective view of components of a peristaltic pump.

FIG. 1 is a perspective view of a peristaltic pump 100, and FIG. 2 is an exploded perspective view of components of the peristaltic pump. As illustrated, the peristaltic pump can comprise a pump housing or head 202 comprising a cavity 203, a rotor 204 that rotates within the cavity 203 of the pump head, a tube or tubing assembly 206, and a pump head cover 208 that encloses the rotor 204 and the tubing assembly 206 within the cavity 203 of the pump head 202. The pump housing or head 202 can be formed such that the tubing assembly 206 is positioned in a loop. However, the pump housing or head 202 can be formed such that the tubing assembly 206 passes in a straight line through the pump housing or head 202. In other words, the pump housing or head 202 can be configured such that the inlet or outlet ports formed therein provide for a loop or straight-line arrangement of the tubing assembly 206 when installed therein.

The tubing assembly 206 can comprise a tube or tubing 240 having connectors 242, 246 that are disposed at the opposing ends of the tube 240. It is contemplated that the connectors 242, 246 may be modified and even omitted in some implementations. The rotor 204 can comprise a plurality of rollers that compress a tube of the tubing assembly within the pump head in order to force fluid through the tube. The rotor can rotate in a clockwise or counterclockwise direction. As will be appreciated, fluid in the tube can be urged within the tube along the direction of travel of the rollers.

As shown in FIG. 2, the rollers can comprise at least one compression roller 222. The compression roller 222 can be configured to compress or pinch the tube 240 against an interior surface of the pump head 202 as the roller 222 rotates within the pump head 202. The compression or pinching of the tube 240 occurs along a length of the tube as the compression roller 222 rotates. The movement and compression urges material disposed within the tube 240 to move through the tube 240 in the direction of rotation of the roller 222. Thus, the compression roller 222 can serve to urge fluid or other material through the tube 240 in the direction of the roller's rotation.

As shown in FIG. 2, in some implementations, the rollers can comprise at least one alignment roller 220. The alignment roller 220 can be formed to comprise a smaller diameter in a central portion thereof and a larger diameter along sides of the roller 220. In this manner, the roller 220 can be configured to maintain the tube within a gap between the rollers and a wall of the pump head. The shape of the roller 220 can allow the tube to be urged toward a center of the roller by side edges thereof.

In use, a pump such as a pharmaceutical peristaltic pump may operate such that the ends of the tube are subjected to low pressures. As another example, a pump such as an industrial peristaltic pump may operate such that the ends of the tube are subjected to high pressures. Additionally, such pumps can also be employed in pumping toxic chemicals. In some implementations, an axle support portion 230 can provide support to an axle of the rotor 204.

To install the tubing assembly, one usually removes the fasteners 250 (e.g., screws) with a tool (e.g., screwdriver) to open the cover 208 and axle support portion 230 to expose the tubing assembly. In prior art peristaltic pumps, the rotor can move up to about 125 rpm (at high pressure if turned "on") or not at all (if turned "off"). However, in order to replace the tubing assembly, one threads the tubing under the rollers of the rotor. Typically, this is attempted in the "off" mode, when the rotor is not moving at all, and the threading of the tubing is extremely difficult. In some instances, an operator finds that although tubing replacement is easier if the rotor is moving in the "on" mode, serious injury can occur with the rotor moving, e.g., at about 125 rpm.

Various implementations described herein include peristaltic pumps and/or methods that can improve the installation of the tubing within a pump head. The peristaltic pump heads desirably can be opened in the off mode to provide quick and easy access to the tubing and/or cavity without tools, and desirably can be closed to provide a secure and robust design usable in not only low pressure applications (e.g., pharmaceutical), but also high pressure applications (e.g., industrial).

Figure 3A:
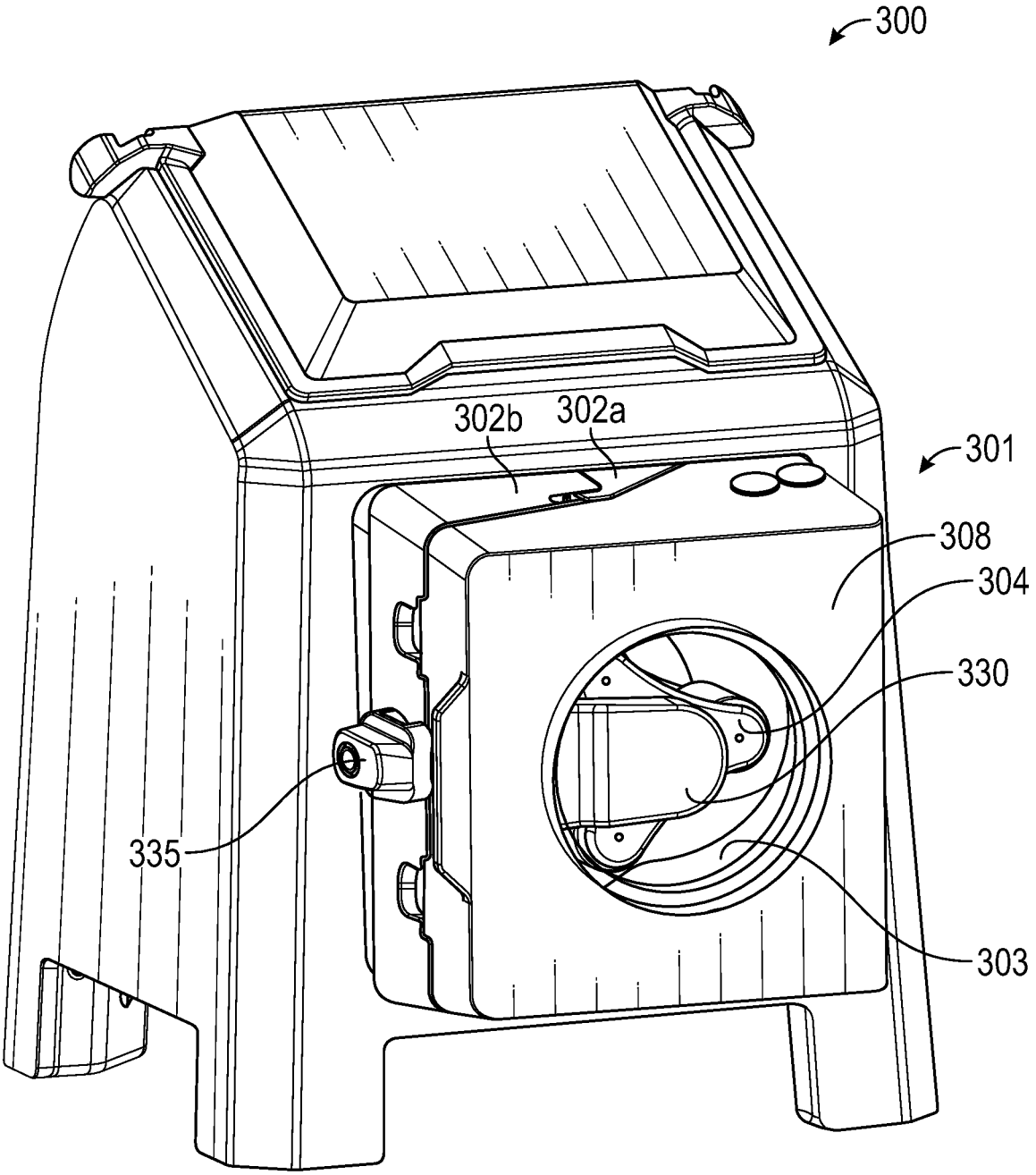
FIGS. 3A, 3B, and 3C are perspective views of a peristaltic pump according to certain implementations described herein.
Figure 3B:
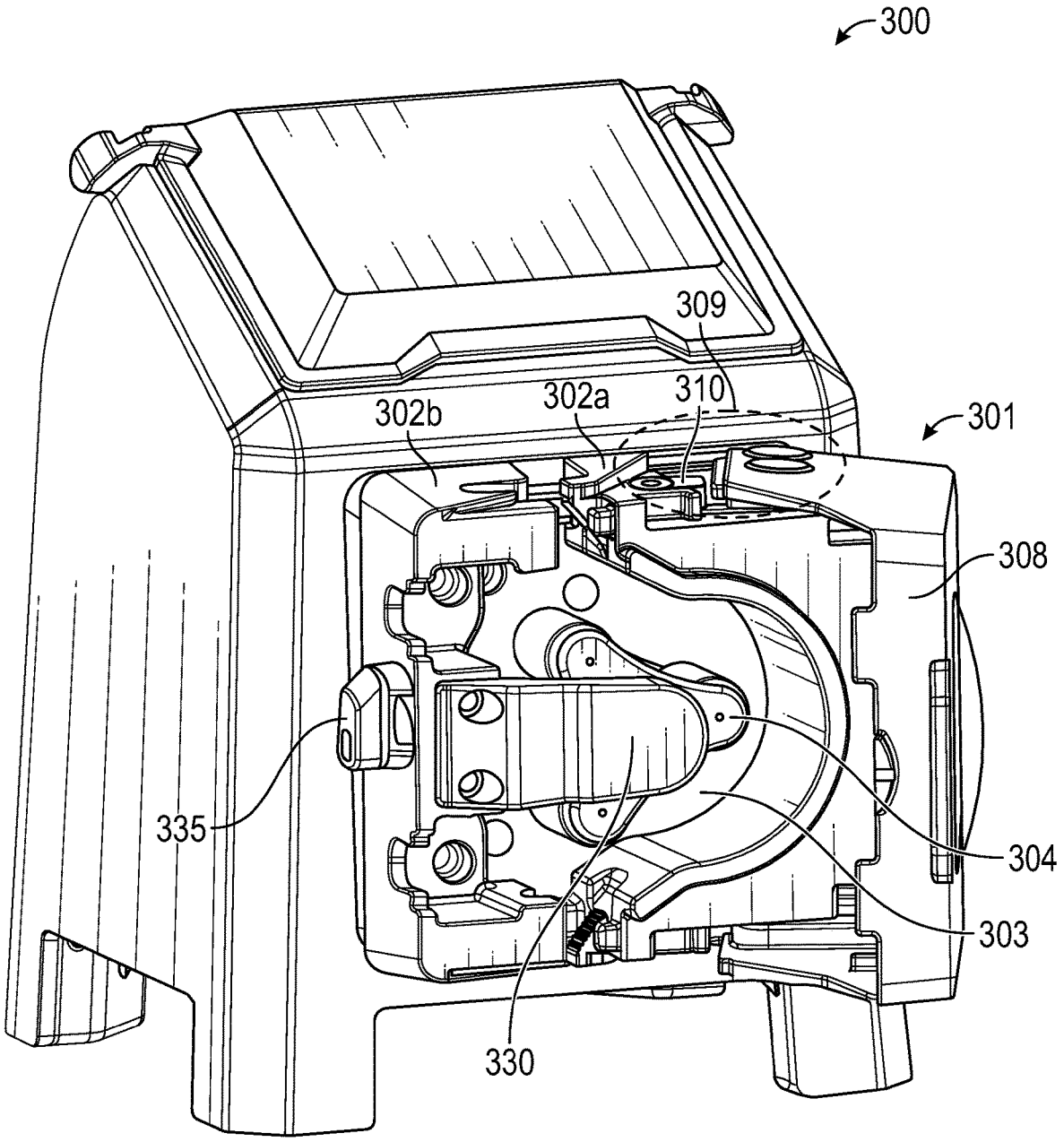
Figure 3C:
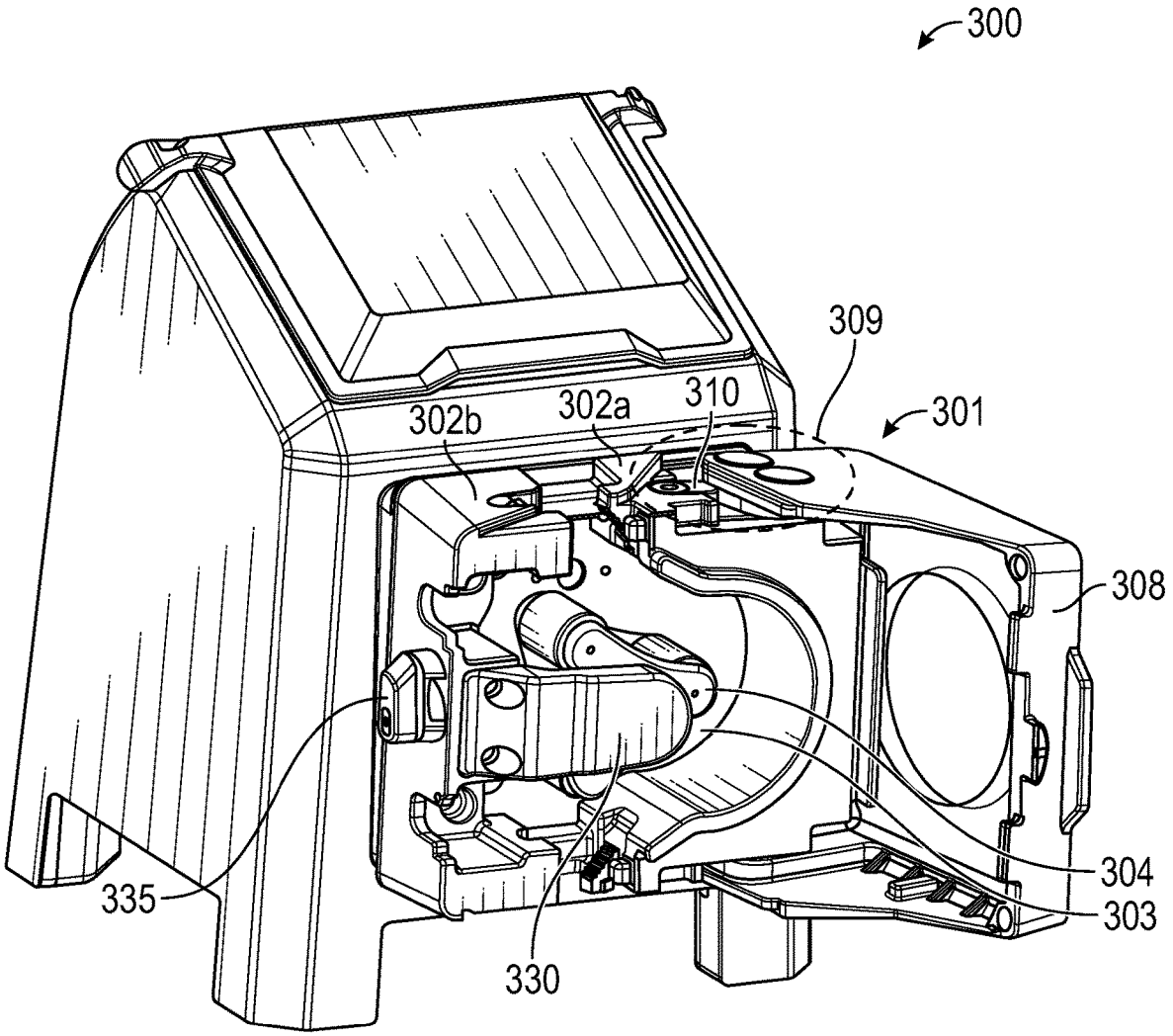

FIGS. 3A and 3B show an example peristaltic pump 300 with a head 301 in the closed and open positions respectively. FIG. 3C shows the example pump 300 with the head 301 in another open position (e.g., a more open position). As shown in these figures, the peristaltic pump 300 can include a movable chassis 302*a* and a chassis retaining portion 302*b* forming a cavity 303. A rotor 304 can be disposed within the cavity 303 such that tubing (not shown for clarity) can be held between the rotor 304 and the chassis 302*a* and/or the chassis retaining portion 302*b*. A cover 308 can enclose the rotor 304 and tubing within the cavity 303. As shown in FIG. 3B-3C, the pump 300 can include a linkage 309 comprising an arm 310 (e.g., instead of fasteners 250 such as screws in FIGS. 1-2) coupling the cover 308 to the chassis 302*a*. The pump head 301 can move from a closed to an open position by lifting or pulling on cover 308 such that no tool (e.g., screwdriver) is necessary. When opening the cover 308, the arm 310 can pivot such that the chassis 302*a* moves away from the chassis retaining portion 302*b* to widen the cavity 303, e.g., as shown in FIG. 3B. Upon further opening of the cover 308, the arm 310 can pivot such that the chassis 302*a* moves farther away from the chassis retaining portion 302*b* to widen the cavity 303 even more, e.g., as shown in FIG. 3C.

The pump head 301 can move from an open to a closed position (e.g., back to the position shown in FIG. 3A) by pushing the cover 308 (e.g., in an opposite direction to opening the cover 308). When closing the cover 308, the arm 310 can pivot such that the chassis 302*a* moves toward the chassis retaining portion 302*b*. When closed, further movement (e.g., of the chassis 302*a* toward and/or away from the chassis retaining portion 302*b*) can be restricted and/or prevented (e.g., with an end 310*a*, 310*b* of an arm 310 and an end of a groove 302*e*, 302*f* in FIG. 6A or with connectors 302*c* and 302*d* in FIGS. 5A-5C as will be described herein). Because further movement can be restricted in the closed position, a robust design with a reduced number of parts rattling during operation can be provided such that the pump can be used in high pressure, as well as in low pressure applications. In addition, because further movement can be restricted in the closed position, the distance between the rotor 304 and the chassis 302*a* and/or chassis retaining portion 302*b* can be maintained, and thus a predictable amount of pressure can be exerted on the tubing. In some instances, a clip 330 (e.g., in addition or instead of the axle support portion 230 in FIGS. 1-2) can be used to hold the rotor 304 in place. In some implementations, a lock 335 can be used to couple the cover 308 and the chassis retaining portion 302*b*.

Figure 4A:
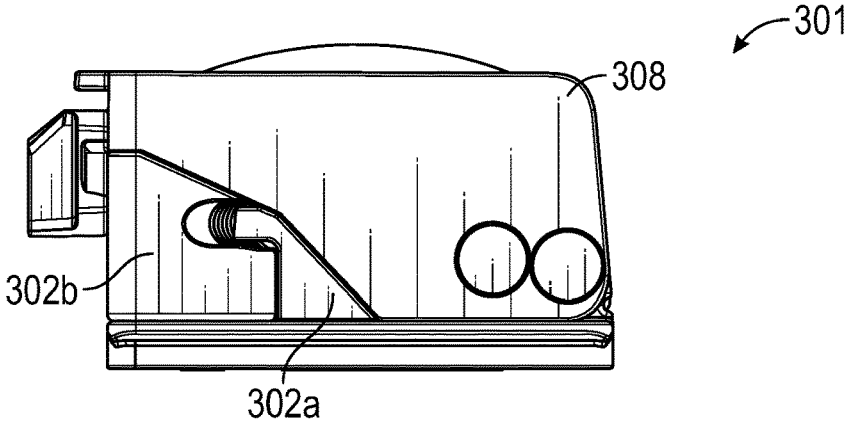
FIGS. 4A, 4B, and 4C are side views of the peristaltic pump head shown in FIGS. 3A, 3B, and 3C.
Figure 4B:
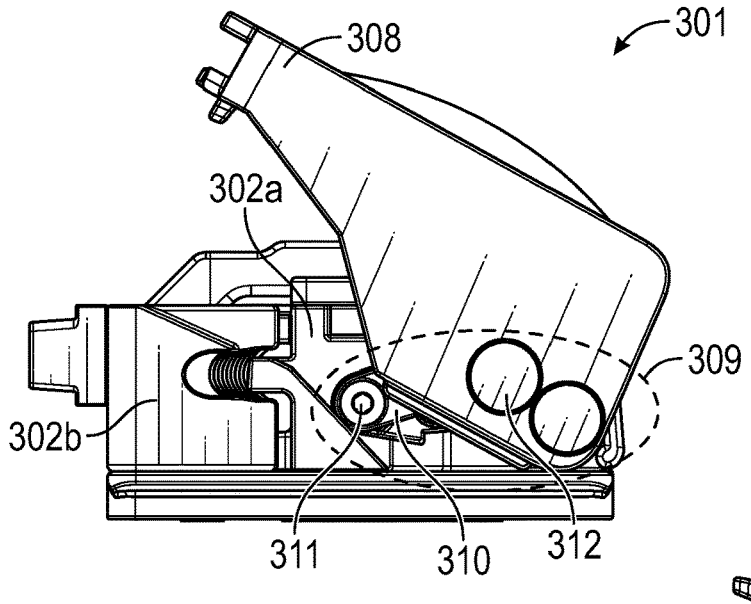
Figure 4C:
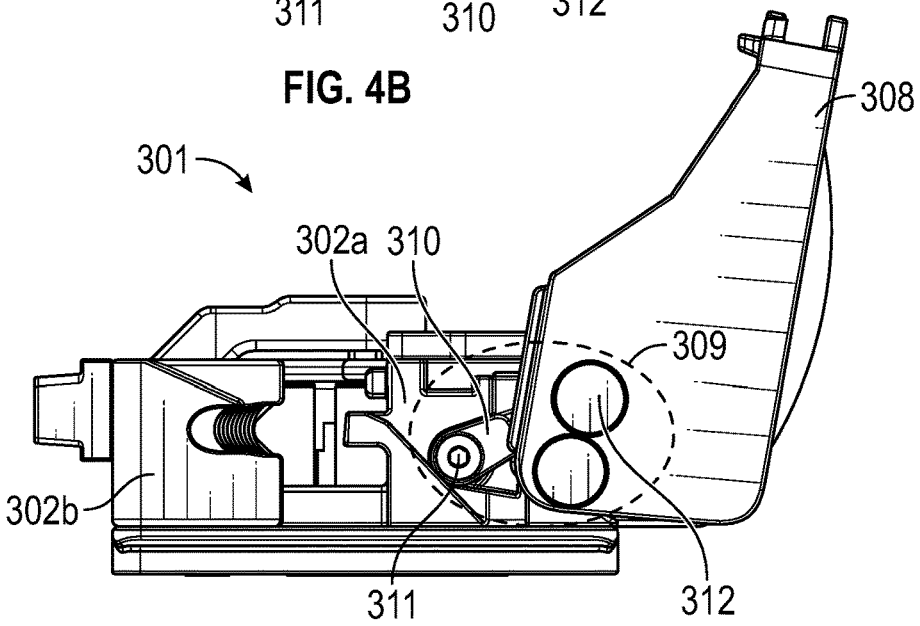

FIGS. 4A, 4B, and 4C are side views of the peristaltic pump head 301 shown in FIGS. 3A, 3B, and 3C. FIG. 4A (similar to FIG. 3A) shows the example pump head 301 in a closed position; and FIGS. 4B and 4C (generally corresponding to the positions shown in FIGS. 3B and 3C) show the example pump head 301 in two different open positions (e.g., an open position and a more open position). In this example, FIG. 4B may be considered as partially opened, while FIG. 4C may be considered as fully opened. However, it will be appreciated that there may be many different open positions (e.g., between FIGS. 4A and 4B, between FIGS. 4B and 4C, and beyond FIG. 4C) and that the fully opened position may be in a different location (e.g., between FIGS. 4B and 4C, or beyond FIG. 4C). In various implementations, the open positions may be based at least in part on design specifications and/or preference. In some instances, the pump head 301 can open continuously (e.g., smoothly) between the closed (e.g., FIG. 4A) and open positions (e.g., FIGS. 4B and 4C). In other instances, the pump head 301 can open discretely among a certain number of positions between the closed and open positions.

Figure 5A:
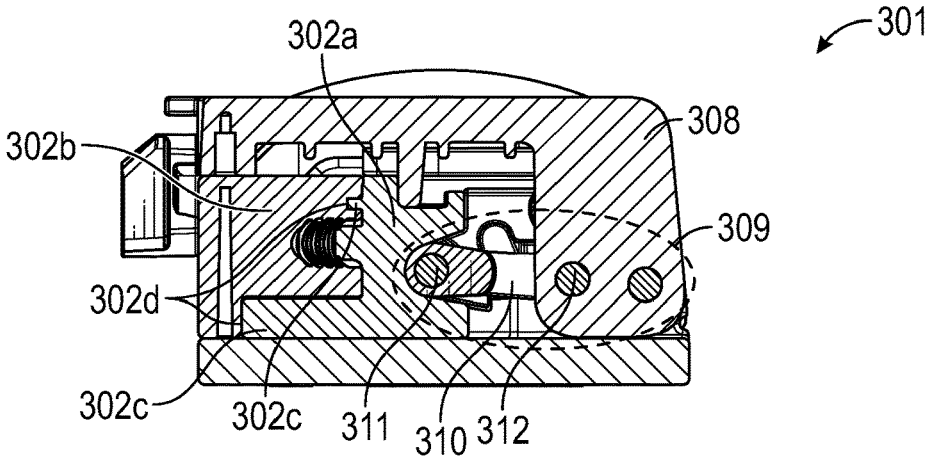
FIGS. 5A, 5B, and 5C are cross-sectional views of the peristaltic pump head shown in FIGS. 4A, 4B, and 4C.
Figure 5B:
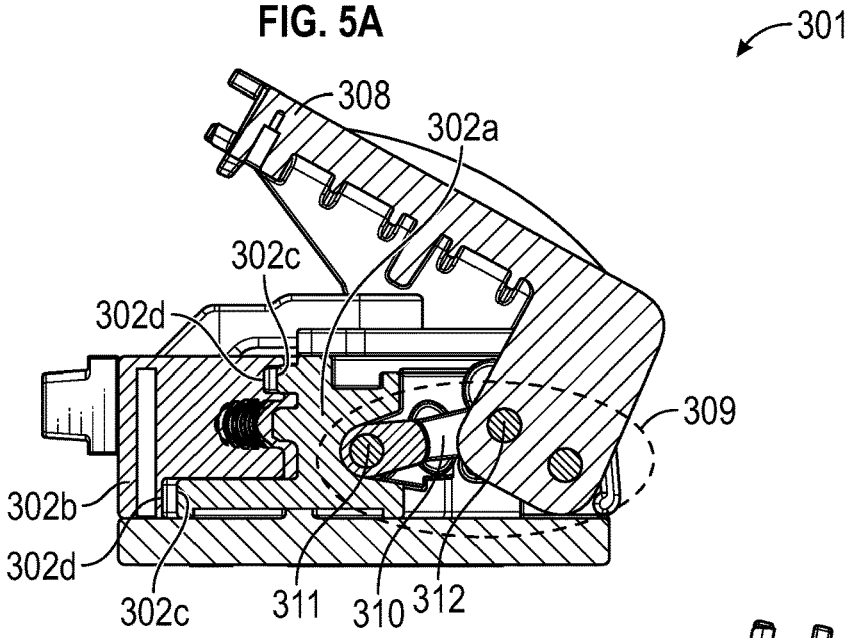
Figure 5C:
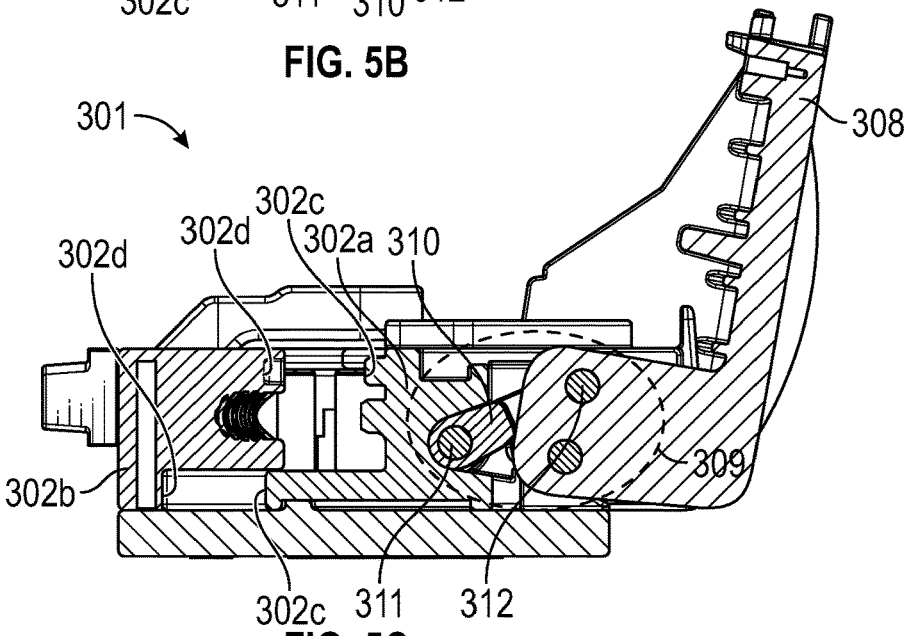

FIGS. 5A, 5B, and 5C show cross-sectional views of the pump head 301 shown in FIGS. 4A, 4B, and 4C. The cross-sections show the chassis 302*a* coupling with the chassis retaining portion 302*b*. In the closed position, the chassis 302*a* and chassis retaining portion 302*b* can couple together using any connection known in the art or yet to be developed. For example, in some instances, as shown in FIGS. 5A-5C, the connection can include one or more male 302*c* and one or more female 302*d* connectors between the chassis 302*a* and chassis retaining portion 302*b*. In FIGS. 5A-5C, the male 302*c* connectors comprise a protrusion and the female 302*a* connectors comprise a recess. The protrusion and recess can be complementary with one another in at least a portion of a cross-sectional shape (e.g., a cross-section into the page). In some instances, the protrusion and recess can have a square, rectangle, triangle, or other polygon cross-sectional shape. In some instances, the protrusion and recess can have a circle, oval, or other curved cross-sectional shape. Other cross-sectional shapes are possible, including but not limited to, irregular shapes or shapes with a combination of flat and curved sides. As shown in FIG. 5A, in the closed position, the chassis 302*a* and chassis retaining portion 302*b* can couple together via the male 302*c* and female 302*d* connectors. As shown in FIGS. 5B-5C, in the open positions, the male 202*c* and female 302*d* connectors can separate from one another.

With reference back to FIGS. 3A-3C, a rotor 304 can be disposed within the cavity 303. In some instances, the rotor 304 can include rollers to compress and/or guide the tubing. Although there are three rollers in this example, the number of rollers (e.g., one, two, three, four, five, six, seven, eight, nine, ten, etc.) is not particularly limited. The size, shape, and/or material of the rotor 304 (and/or rollers) may be determined with respect to the intended pressure to exert onto the tubing. For example, larger, more protruding, and/or harder rotors (and/or rollers) may exert higher pressures than smaller, more receding, and/or softer ones. In some instances, the rotor 304 can be removable. For instance, a rotor 304 may be removed and/or replaced with another rotor to adjust the pressure. As another example, a rotor 304 may be removed and/or replaced with another rotor in case of wear, tear, and/or damage to the rotor 304.

When the pump head 301 is opened, the tubing (e.g., tube 240 in FIG. 2) can be placed between the rotor 304 and the chassis 302*a* and/or the chassis retaining portion 302*b*. Afterwards, the cover 308 can be closed, bringing the chassis 302*a* towards the chassis retaining portion 302*b*. In some implementations, when closed, the chassis 302*a* moves toward the chassis retaining portion 302*b* such that the tubing is held between the rotor 304 and the chassis 302*a* and/or chassis retaining portion 302*b*, e.g., with a certain pressure.

With reference to FIGS. 4A-4C and FIGS. 5A-5C, a linkage 309 can couple the cover 308 to the chassis 302*a*. The linkage 309 includes an arm 310 that pivots between the closed and open positions. In these figures, the linkage 309 comprises a first pivot 311 secured relative to the chassis 302*a* and a second pivot 312 secured relative to the cover 308. When opening and closing the cover 308, the cover 308 pivots about the second pivot 312, causing the arm 310 to pivot about the first pivot 311.

Figure 6A:
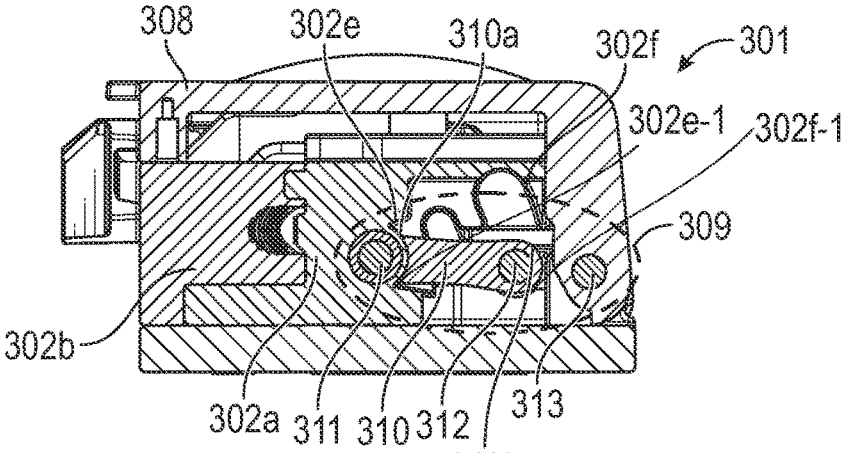
FIGS. 6A, 6B, and 6C are additional cross-sectional views of the peristaltic pump head shown in FIGS. 4A, 4B, and 4C.
Figure 6B:
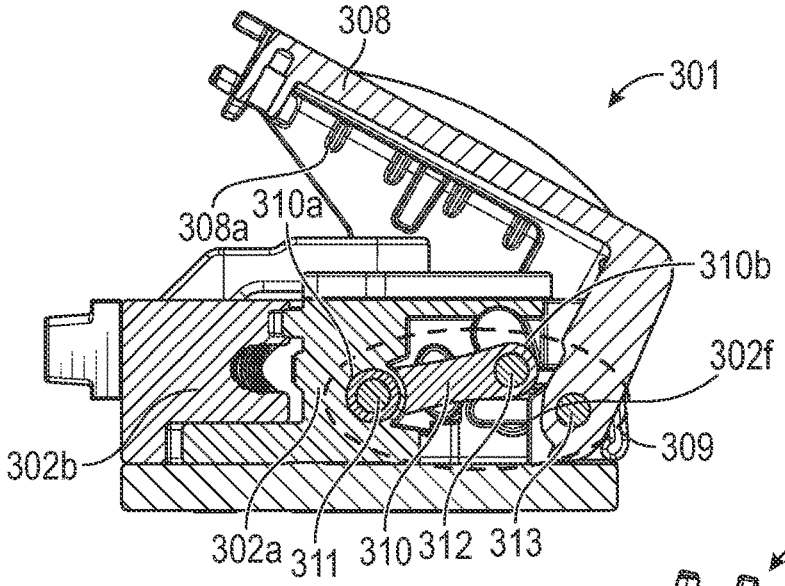
Figure 6C:
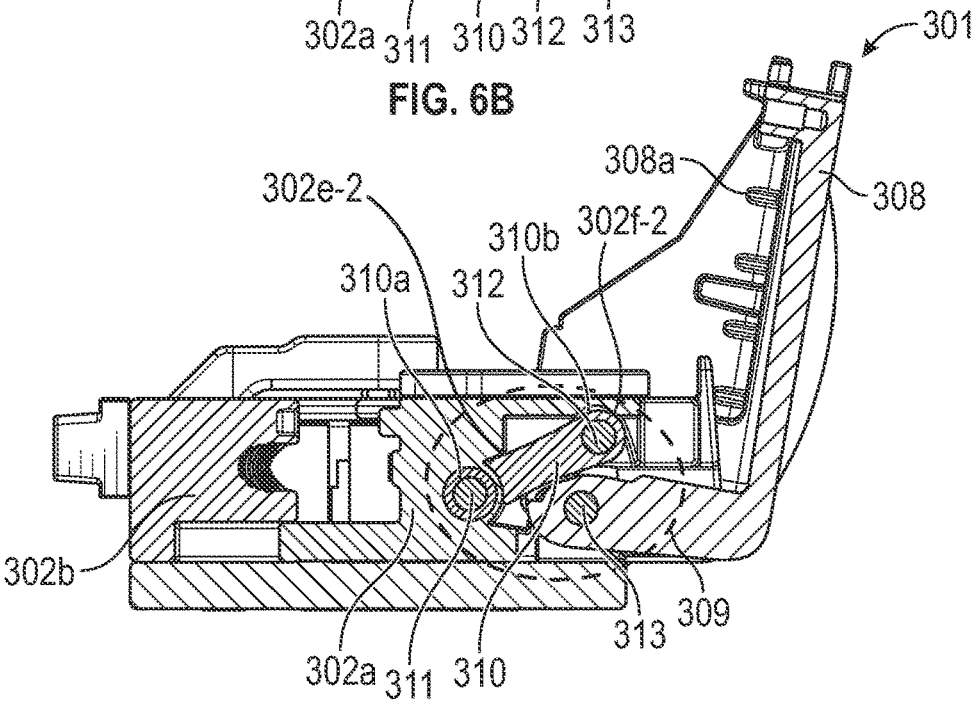

FIGS. 6A, 6B, and 6C show additional cross-sectional views revealing both ends 310*a*, 310*b* of the arm 310. In this example, the first end 310*a* of the arm 310 is positioned at, adjacent, or near the first pivot 311 and the second end 310*b* of the arm 310 is positioned at, adjacent, or near the second pivot 312. In addition, when opening the cover 308, the cover 308 is configured to contact the second end 310*b* of the arm 310 to cause the arm 310 to pivot about the first pivot 311. For example, as the cover 308 is opened (e.g., from FIG. 6A to FIG. 6B), a portion of the cover 308 can move closer to the second end 310*b* of the arm 310. As the cover 308 is opened further (e.g., from FIG. 6B to 6C), a portion of the cover 308 can contact the second end 310*b* of the arm 310 to help pivot the arm 310. As the cover 308 is opened even further, a portion of the cover 308 can contact the arm 310 such as between the first and second ends 310*a*, 310*b* (e.g., FIG. 6C) to help support the arm 310. In some examples, the cover 308 can also pivot about a third pivot 313. The cover 308 can be coupled to the chassis 302*a* at the third pivot 313.

Figure 7A:
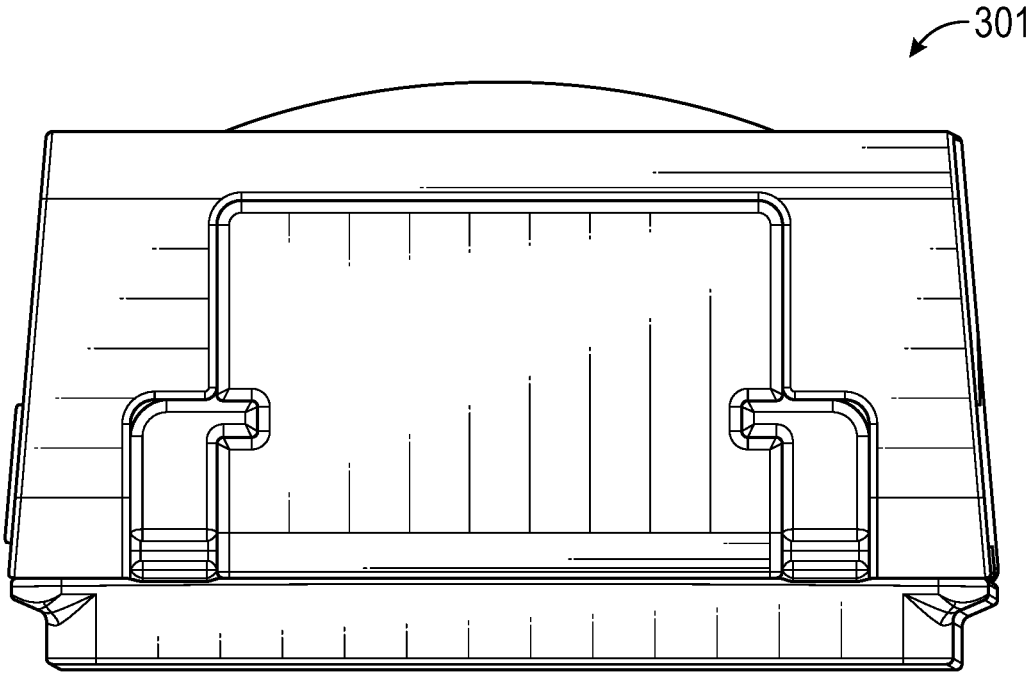
FIG. 7A is a back view of the peristaltic pump head shown in FIG. 4A.
Figure 7B:
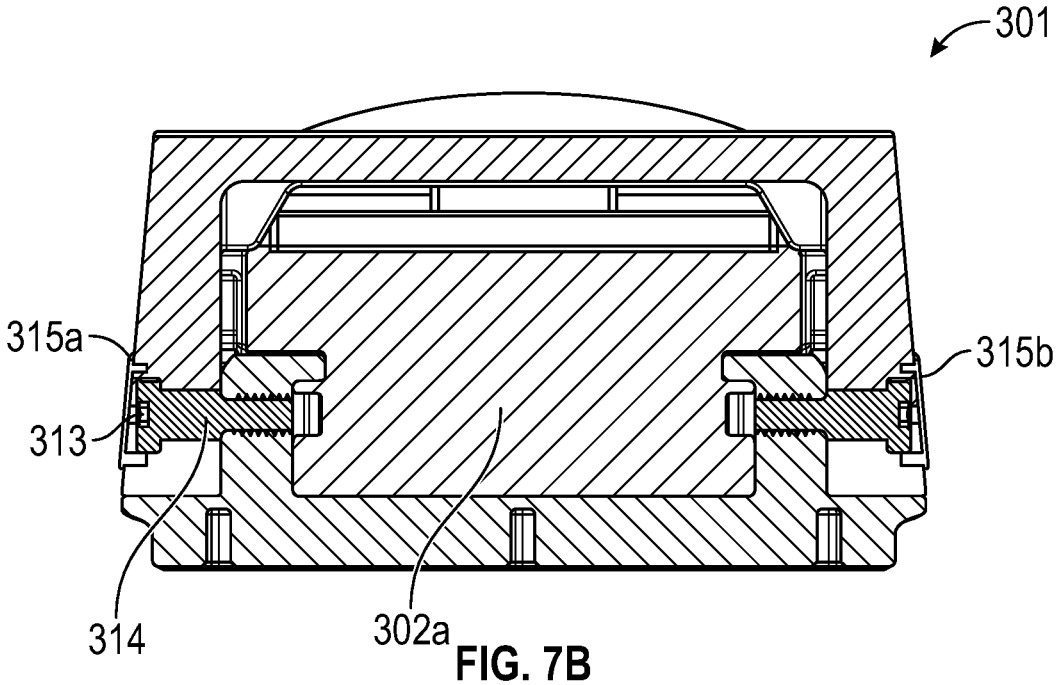
FIG. 7B is a cross-sectional view of the peristaltic pump head shown in FIG. 7A.

FIG. 7A shows a back view of the pump head 301 in the closed position, and FIG. 7B shows a cross-sectional view of the back view shown in FIG. 7A. As shown, the cover 308 can be coupled to the chassis 302*a* at the third pivot 313 via a fastener 314 (such as a screw). Although the linkage 309 was described with respect to FIGS. 4A-6C as having an arm 310 on one side of the chassis 302*a*, it would be appreciated that the linkage 309 can have arms on two sides of the chassis 302*a*. For example, with reference to FIG. 7B, the arm 310 of the linkage can be disposed on a first side 315*a* of the chassis 302*a* and another arm can be disposed on a second side 315*b*, e.g., opposite the first side 315*a* of the chassis 302*a*. The second arm on the second side 315*b* can be and operate similar to the first arm 310 (e.g., as described with respect to FIGS. 4A-6C) on the first side 315*a*. It will be also appreciated that the one or more male 302*c* and one or more female 302*d* connectors between the chassis 302*a* and chassis retaining portion 302*b*, as described with respect to FIGS. 5A-5C, can also be disposed on the both sides 315*a*, 315*b* of the chassis 302*a*.

In various implementations, the pump head 301 can provide a robust and sturdy design that reduces the amount of moving parts and rattling during operation, which is advantageous in high pressure applications and also for maintaining a known pressure on the tubing. As an example, when closed, further movement can be restricted and/or prevented toward the chassis retaining portion 302*b*. In some implementations, a stop can restrict and/or prevent further movement of a corresponding member toward the chassis retaining portion 302*b*. The corresponding member can be an end 310*a* of the arm 310 (e.g., as shown in FIG. 6A). When closed, the end 310*a* of the arm 310 can be within 2 mm, 1 mm, or even contact a stop. In some examples, with reference to FIG. 6A, the stop can be formed by an end of a groove 302*e*. The arm 310 can be disposed within the groove 302*e*, e.g., a groove 302*e* disposed in the chassis 302*a*.

In various implementations, when closed, further movement can be restricted and/or prevented away from the chassis retaining portion 302*b*. For example, as shown in FIG. 6A, a first stop, such as the end of a first groove 302*e* (e.g., a fully-closed first stop 302*e*-1) can cooperate with a second stop, such as the end of the second groove 302*f* (e.g., a fully-closed second stop 302*f*-1) to restrict and/or prevent further movement of a first corresponding member, such as the first end 310*a* of the arm 310, and a second corresponding member, such as the second end 310*b* of the arm 310, respectively. In some examples, when closed, the first end 310*a* and the second end 310*b* of the arm 310 can be within 2 mm, within 1 mm, or even contact the first and second stop respectively. In some instances, the first end 310*a* of the arm 310 can be disposed in the first groove 302*e* (e.g., a fully-closed first stop 302*e*-1) and the second end 310*b* of the arm 310 can be disposed in the second groove 302*f* (e.g., a fully-closed second stop 302*f*-1). Because movement of the arm 310 can be restricted in the closed position, movement of the chassis 302*a* toward and/or away from the chassis retaining portion 302*b* can also be restricted. As shown in FIG. 6C, when opened, the first end 310*a* of the arm 310 can be disposed in the first groove 302*e* (e.g., a fully-opened first stop 302*e*-2) and the second end 310*b* of the arm 310 can be disposed in the second groove 302*f* (e.g., a fully-opened second stop 302*f*-2).

Additionally or alternatively, the stop and corresponding member can include one or more male 302*c* and one or more female 302*d* connectors (e.g., as described with respect to FIGS. 5A-5C) between the chassis 302*a* and the chassis retaining portion 302*b*. Additionally or alternatively, the stop and corresponding member can include one or more male and one or more female connectors between the cover 308 and the chassis 302*a* and/or chassis retaining portion 302*b* (e.g., similar to those described with respect to FIGS. 5A-5C between the chassis 302*a* and the chassis retaining portion 302*b*). FIGS. 6B and 6C show some possible male connectors 308*a* (e.g., tabs) in the cover 308 that can be configured to couple with female connectors (not shown) in the chassis 302*a* and/or the chassis retaining portion 302*b*.

Figure 8A:
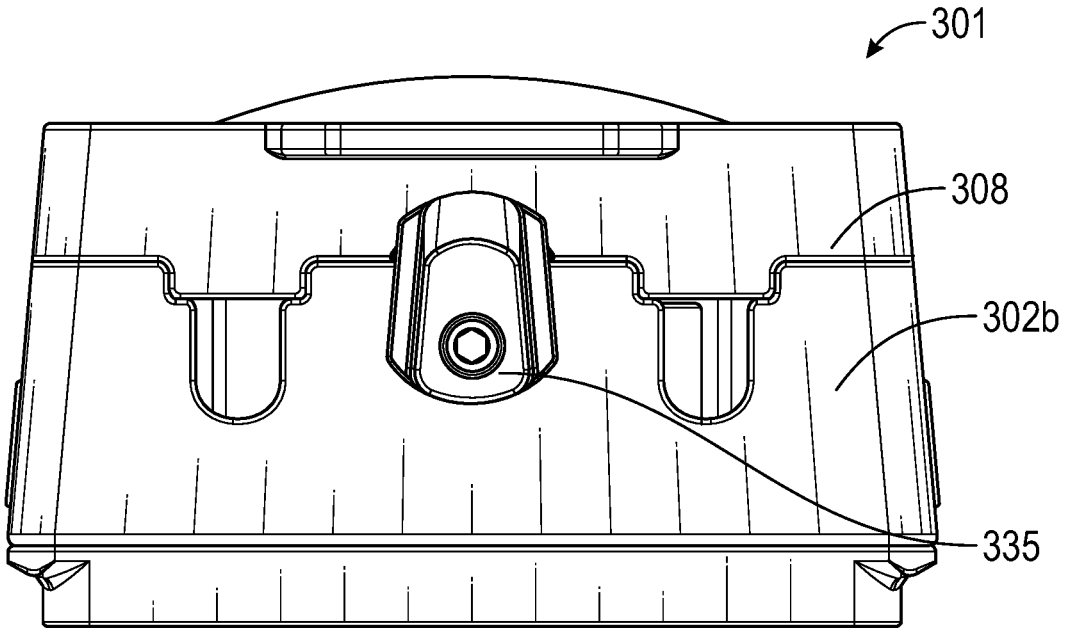
FIGS. 8A and 8B are front views of the peristaltic pump head shown in FIG. 4A.
Figure 8B:
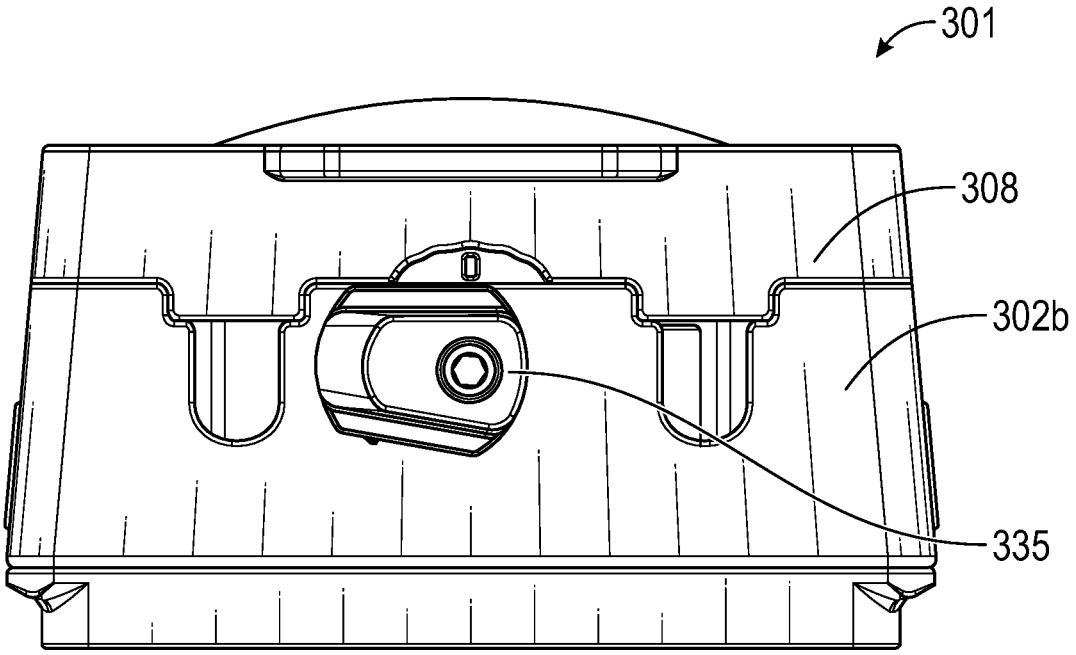
Figure 8C:
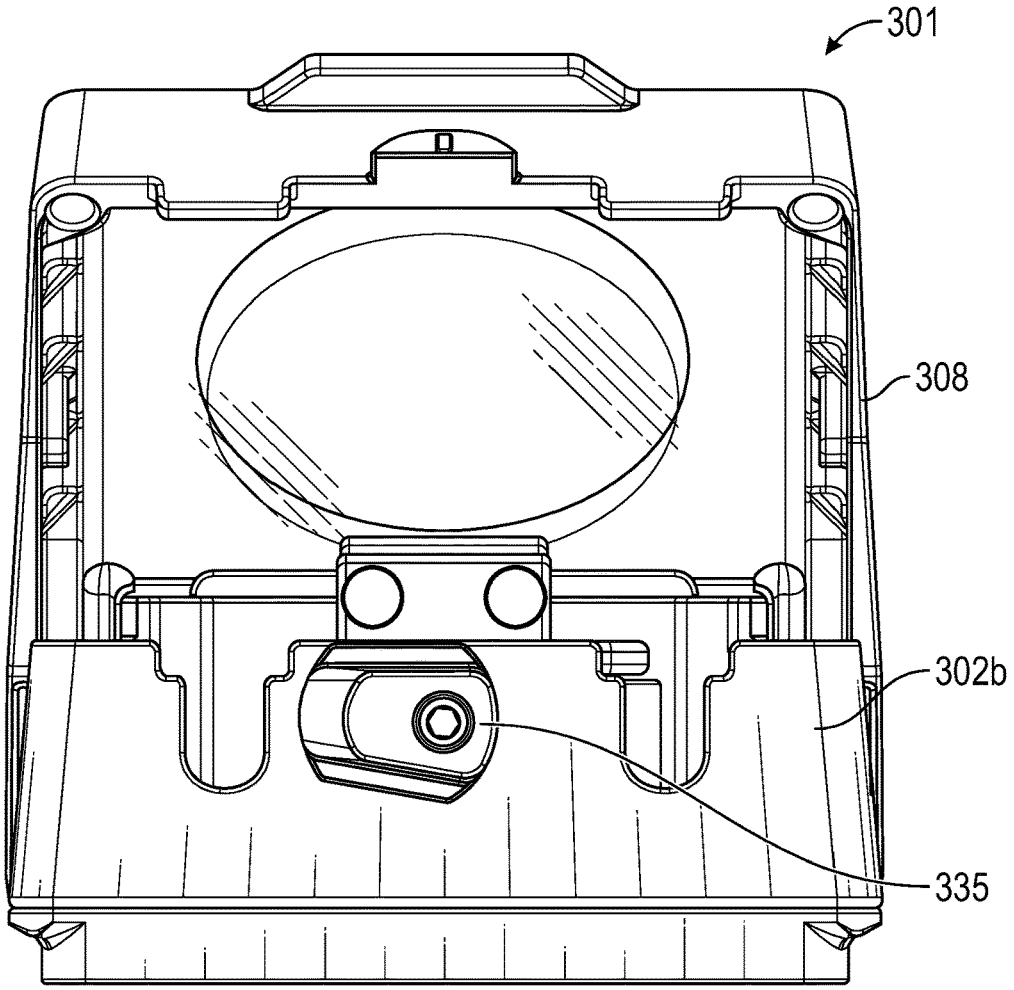
FIG. 8C is a front view of the peristaltic pump head shown in FIG. 4B. The pump head is unlocked and in an open position.

As shown in FIGS. 3A-3C, to further reduce the amount of parts moving and rattling during operation, some implementations can desirably include a clip 330 configured to couple the rotor 304 and the chassis retaining portion 302*b* to hold the rotor 304 in place. FIGS. 8A-8C show front views of the example pump head 301. As shown, a lock 335 can be used to couple the cover 308 and the chassis retaining portion 302*b*. FIG. 8A shows the lock 335 in a locked position. When closed, the lock 335 can be configured to help keep the cover 308 coupled to the chassis retaining portion 302*b*. FIG. 8B shows the lock 335 in an unlocked position. When unlocked, the cover 308 can be configured to be movable away from the chassis retaining portion 302*b*, opening the pump head 301. FIG. 8C shows the pump head 301 in the open position with the cover 308 extending away from the chassis retaining portion 302*b*.

The materials of the components (e.g., the chassis 302*a*, chassis retaining portion 302*b*, rotor/rollers 304, tubing, cover 308, linkage 309, clip 330, and/or lock 335, etc.) described herein can be made of any material known in the art or yet to be developed. For example, one or more of the components can be made of a metal, ceramic, polymer, or any combination of materials thereof.

Figure 9:
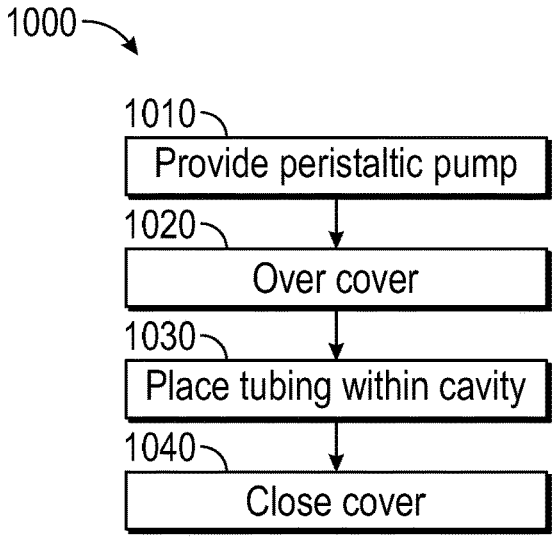
FIG. 9 illustrates a method of installing tubing in a peristaltic pump according to certain implementations described herein.

As describe herein, various pumps can allow improved tubing installation into a peristaltic pump. FIG. 9 shows a flowchart of an example method of installing tubing into a peristaltic pump. The method 1000 can include providing a peristaltic pump, as shown in block 1010. The pump can include any of the pumps described herein. For example, the pump can include a chassis and a chassis retaining portion. The chassis and the chassis retaining portion can form a cavity. The pump can also include a rotor, a cover, and a linkage. The rotor can be disposed within the cavity. The linkage can couple the cover to the chassis. The linkage can comprise an arm. As shown in block 1020, the method 1000 can include opening the cover, causing the arm to pivot such that the chassis moves away from the chassis retaining portion to widen the cavity. The method 1000 can also include placing the tubing within the cavity, as shown in block 1030. Further, as shown in block 1040, the method 1000 can include closing the cover, causing the arm to pivot such that the chassis moves toward the chassis retaining portion and restricting further movement toward the chassis retaining portion.

In some methods, the closing step shown in block 1040 can include closing the cover so that when closed, an end of the arm can be within 2 mm, 1 mm, or even contact a stop. In some methods, when closing the cover, the method 1000 can include restricting further movement away from the chassis retaining portion. For example, when closed, each end of the arm can be within 2 mm, 1 mm, or even contact a first and second stop respectively.

Additionally or alternatively, the method 1000 can include connecting male and female connectors between the chassis and the chassis retaining portion. Additionally or alternatively, the method 1000 can include connecting male and female connectors between the cover and the chassis and/or chassis retaining portion.

In some implementations, the method 1000 can include placing a rotor within the cavity prior to closing the cover. The method can also include placing a clip to hold the rotor in place. The method 1000 can also include locking the cover to the chassis retaining portion.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A peristaltic pump comprising:

a chassis and a chassis retaining portion forming a cavity;

a rotor disposed within the cavity such that tubing can be held between the rotor and the chassis and/or the chassis retaining portion;

a cover; and a linkage coupling the cover to the chassis, the linkage comprising an arm, the arm comprising a first end and a second end, wherein the first end of the arm is disposed in a first groove formed by the chassis, wherein when opening the cover, the arm pivots such that the chassis moves away from the chassis retaining portion to widen the cavity, wherein when the cover is in a fully-opened position, the second end of the arm is disposed in a second groove formed by the chassis, wherein when closing the cover, the arm pivots such that the chassis moves toward the chassis retaining portion, and wherein when closed, a first stop formed by the first groove restricts further movement of the first end of the arm toward the chassis retaining portion.

2. The peristaltic pump of claim 1, wherein when closed, the first end of the arm is within 2 mm of the first stop.

3. The peristaltic pump of claim 2, wherein when closed, the first end of the arm is within 1 mm of the first stop and the second end of the arm is within 1 mm of a second stop formed by the second groove.

4. The peristaltic pump of claim 3, wherein when closed, the first end of the arm contacts the first stop and the second end of the arm contacts the second stop.

5. The peristaltic pump of claim 1, wherein the linkage comprises a first pivot secured relative to the chassis and a second pivot secured relative to the cover.

6. The peristaltic pump of claim 5, wherein when opening and closing the cover, the cover pivots about the second pivot, causing the arm to pivot about the first pivot.

7. The peristaltic pump of claim 6, wherein the first end of the arm is positioned at the first pivot.

8. The peristaltic pump of claim 7, wherein when opening the cover, the cover is configured to contact the second end of the arm to cause the arm to pivot about the first pivot.

9. The peristaltic pump of claim 1, further comprising male and female connectors between the cover and the chassis and/or chassis retaining portion.

10. The peristaltic pump of claim 1, further comprising a lock configured to couple the cover and the chassis retaining portion.

11. The peristaltic pump of claim 1, wherein the rotor is removable.

12. The peristaltic pump of claim 1, comprising a clip configured to couple the rotor and the chassis retaining portion to hold the rotor in place.

13. A method of installing tubing into a peristaltic pump, the method comprising:

providing the peristaltic pump, the peristaltic pump comprising:

a chassis and a chassis retaining portion forming a cavity, a rotor disposed within the cavity, a cover, and a linkage coupling the cover to the chassis, the linkage comprising an arm, the arm comprising a first end and a second end, wherein the first end of the arm is disposed in a first groove formed by the chassis;

opening the cover, causing the arm to pivot such that the chassis moves away from the chassis retaining portion to widen the cavity, wherein when the cover is in a fully-opened position, the second end of the arm is disposed in a second groove formed by the chassis;

placing the tubing within the cavity; and closing the cover, causing the arm to pivot such that the chassis moves toward the chassis retaining portion and restricting by a first stop formed by the first groove, further movement of the first end of the arm toward the chassis retaining portion.

14. The method of claim 13, wherein the closing step comprises closing the cover so that when closed, the first end of the arm is within 2 mm of the first stop.

15. The method of claim 14, wherein the closing step comprises closing the cover so that when closed, the first end of the arm is within 1 mm of the first stop and the second end of the arm is within 1 mm of a second stop formed by the second groove.

16. The method of claim 15, wherein the closing step comprises closing the cover so that when closed, the first end of the arm contacts the first stop and the second end of the arm contacts the second stop.

17. The method of claim 13, further comprising connecting male and female connectors between the cover and the chassis and/or chassis retaining portion.

18. The method of claim 13, comprising locking the cover to the chassis retaining portion.

19. The method of claim 13, comprising placing a rotor within the cavity prior to closing the cover.

20. The method of claim 13, comprising placing a clip to hold the rotor in place.

* * * * *